US006041523A

United States Patent [19]

Deloreia

[11] Patent Number: 6,041,523

[45] Date of Patent: Mar. 28, 2000

[54] METHOD FOR WEIGHT-TRAINING USING A SHOE INSERT

[76] Inventor: Wayne H. Deloreia, 160 17th Street Pl. NW. B3, Hickory, N.C. 28601

[21] Appl. No.: 08/813,307

[22] Filed: Mar. 10, 1997

[51] Int. Cl.[7] ..... A43B 7/16; A43B 19/00

[52] U.S. Cl. ..... 36/71; 36/81; 36/37; 36/35 R; 36/92; 36/172

[58] Field of Search ..... 36/71, 81, 37, 36/35 R, 92, 172, 173

[56] References Cited

U.S. PATENT DOCUMENTS

| | | | |
|---|---|---|---|
| 491,756 | 2/1893 | Levy | 36/37 |
| 1,195,327 | 8/1916 | Arrowsmith | 369/37 |
| 3,124,887 | 3/1964 | Vassar | 36/81 |
| 3,984,926 | 10/1976 | Calderon | 36/37 |
| 4,120,102 | 10/1978 | Kenigson | 36/71 |
| 5,437,111 | 8/1995 | Kousaka et al. | 36/71 |

OTHER PUBLICATIONS

"KARHU" Shoe, 1970s.

*Primary Examiner*—Paul T. Sewell
*Assistant Examiner*—Anthony Stashick
*Attorney, Agent, or Firm*—Coats & Bennett, P.L.L.C.

[57] ABSTRACT

A weight-training method uses a shoe insert to elevate the user's heel while performing weight-training exercises, such as squats. The method entails placing a wedge-shaped shoe insert into the user's shoe at the start of a weight-training exercise to raise the user's heel. The wedge-shaped insert is made of a relatively hard rubber or thermoplastic material and is shaped to fit into the heel portion of the user's shoe.

4 Claims, 4 Drawing Sheets

METHOD FOR WEIGHT-TRAINING USING A SHOE INSERT

FIELD OF THE INVENTION

The present invention relates generally to weight-training devices and more particularly to shoe insert for use during weight-training exercises.

BACKGROUND OF THE INVENTION

Weight-training is both a popular sport and leisure-activity. Some people engage in weight-training as part of an exercise regimen to maintain overall fitness. Others engage in weight-training for the purpose of body building. Whatever the objective, weight-training can improve the health and fitness of those involved. However, if weight-training is not properly done, the person can be injured.

One potential source of injury arises during a weight-training exercise known as squats. In this exercise, a person stands in an upright position. The person's heels are usually elevated, for example, by resting the heels on a board as shown in FIG. 1. The person then moves his or her buttocks rearward and downward as if sitting in a chair. When the person reaches a position in which the person's thighs are roughly parallel to the ground, the person returns to an upright position. Usually, this exercise is performed while weights are supported on the person's shoulders to provide resistance.

The prevailing practice of using a board to elevate the person's heels is dangerous. The person must first get the weights onto his or her shoulders and then "back-up" to find the board. The board therefore poses a tripping hazard to the person which can be very dangerous if heavy weights are involved. Moreover, the process of getting into the proper position causes the person to expend energy unnecessarily. The energy expended could be better used performing weight-training exercises.

Accordingly, there is a need for an improved method of performing squats and other weight-training exercises which require that the person's heels be elevated during the exercise.

SUMMARY OF THE INVENTION

The present invention provides a shoe insert for use during weight-training exercises. The shoe insert is specifically adapted for use while doing "squats" but may also be used for other weight-training exercises. The shoe insert has a generally wedge-shaped configuration and fits into the heel of a shoe. The shoe insert is placed into the shoe before beginning the weight-training exercise to raise the height of the user's heel.

The shoe insert of the present invention provides a much safer method for doing many weight-training exercises. When the shoe insert of the present invention is used, there is no need for user to "back-up" to find a board as is the common practice today. Thus, the shoe insert eliminates one of the hazards associated with many weight-training exercises.

Another advantage of the shoe insert of the present invention is that it is more comfortable for the user and is better for the user's arches. When the present invention is used, the arch will be supported even though the height of the heel has been raised in contrast to the prevailing methods used in weight-training exercises today.

DETAILED DESCRIPTION OF THE INVENTION

Figure 1:
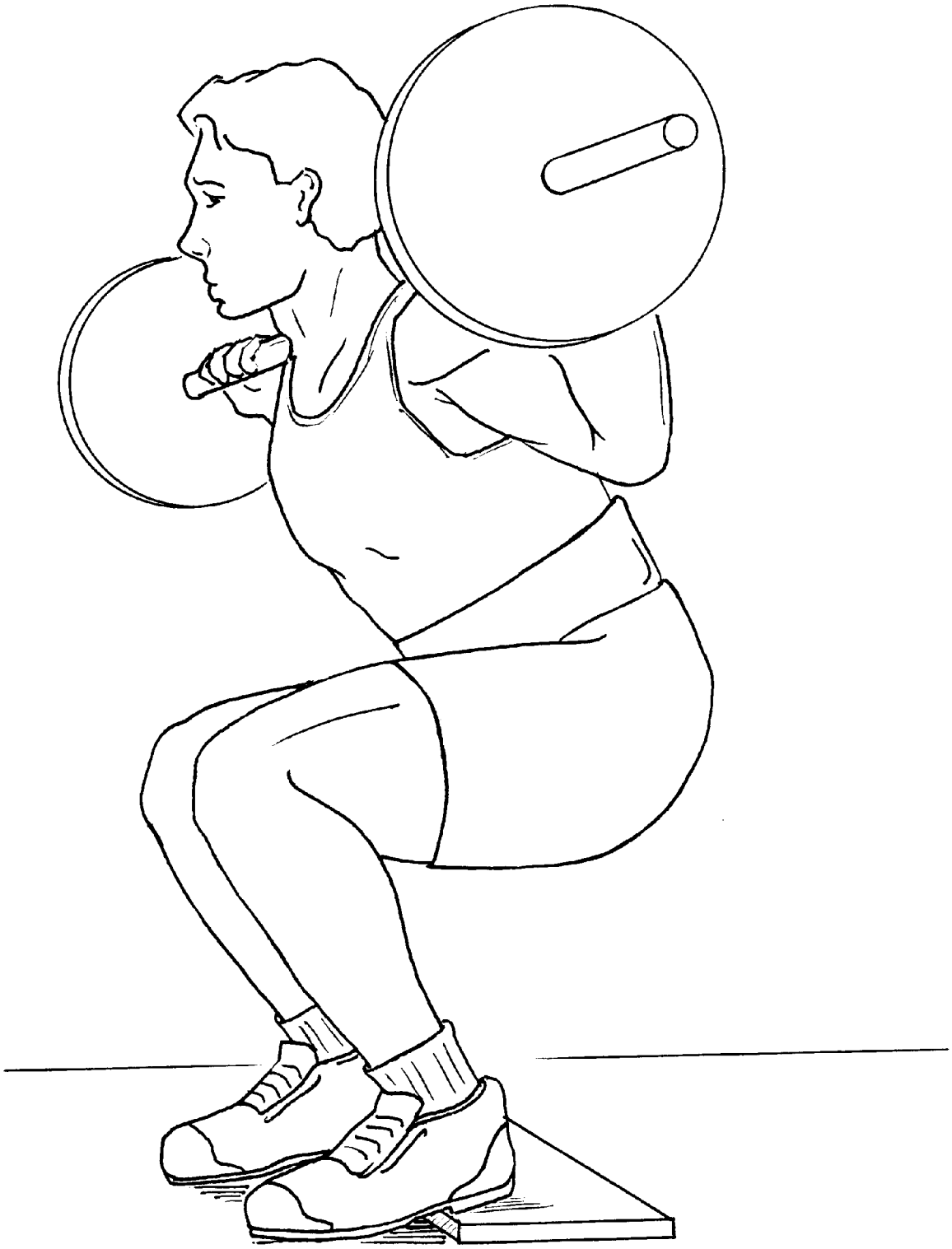
FIG. 1 is a perspective view of a man doing "squats" according to the prior art method.
Figure 3:
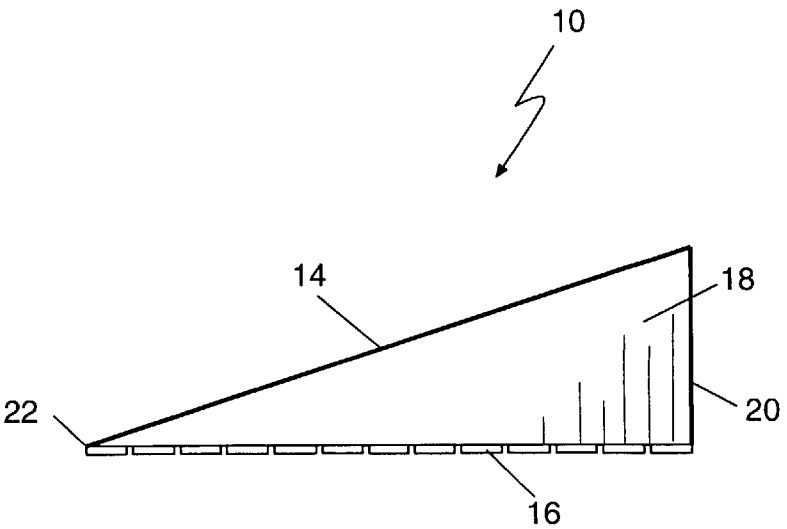
FIG. 3 is an elevation view of the shoe insert of the present invention.
Figure 2:
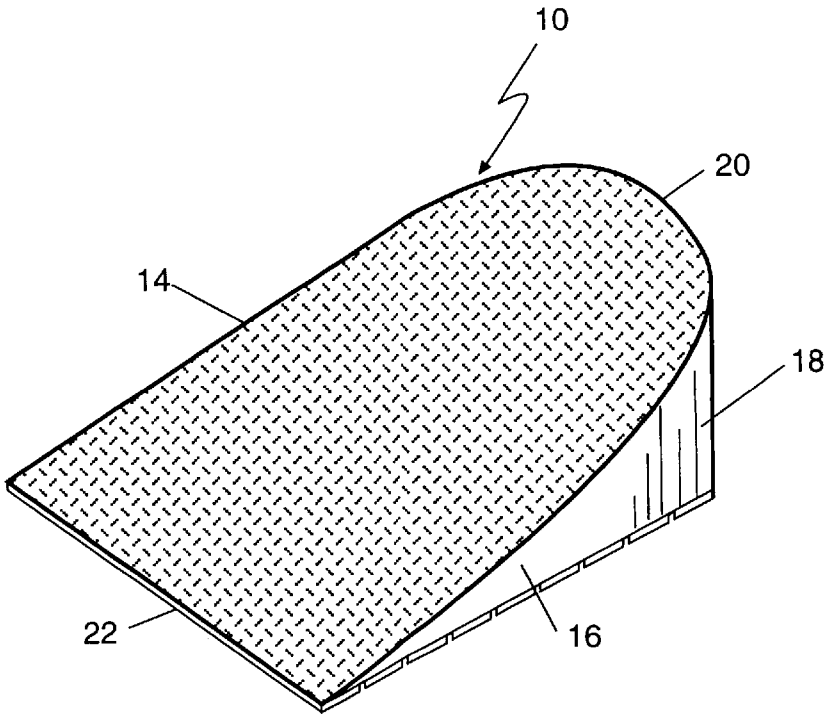
FIG. 2 is a perspective view of the shoe insert of the present invention.

Referring now to the drawings, and particularly to FIGS. 2–5, the shoe insert of the present invention is shown and indicated generally by the numeral 10. The shoe insert 10 has a generally wedge-shaped configuration as shown most clearly in FIG. 3. The shoe insert 10 includes a top surface 14, a bottom surface 16, and a side wall 18. The top surface 14 slopes from the rear end 20 of the shoe insert 10 to the front end 22. The bottom surface 16 is textured to prevent the insert 10 from slipping within the user's shoe during use. The top surface 14 and side wall 18 are both smooth.

The size and configuration of the shoe insert 10 is such that the shoe insert 10 fits easily into the heel of shoes of varying size. The front end 12 of the shoe insert 10 comprises a straight edge extending across the width of the shoe insert 10. The rear end 20 of the shoe insert is rounded. The shoe insert 10 is approximately two and one-half inches in width (i.e. side to side) and approximately three and one-half inches in length (i.e. front to rear).

Shoe insert 10 is molded from a synthetic rubber or thermoplastic material. The shoe insert 10 is preferably formed by injection-molding although other molding processes may also be used. A neoprene rubber having a hardness of approximately 50 on the Shore A scale is a suitable material for the shoe insert 10. Also a Nitril® rubber with a similar hardness would be a suitable material.

The shoe insert 10 is designed for use during weight-training exercises such as "squats." The shoe insert 10 is placed in the heel of the shoe at the start of the exercise to raise the user's heel. In a preferred embodiment of the invention, the height of the shoe insert 10 at the rear end 14 is approximately one inch. After the shoe insert 10 is placed in the shoe, the user secures the shoe to his or her foot and then performs the weight-training exercise.

Figure 5:
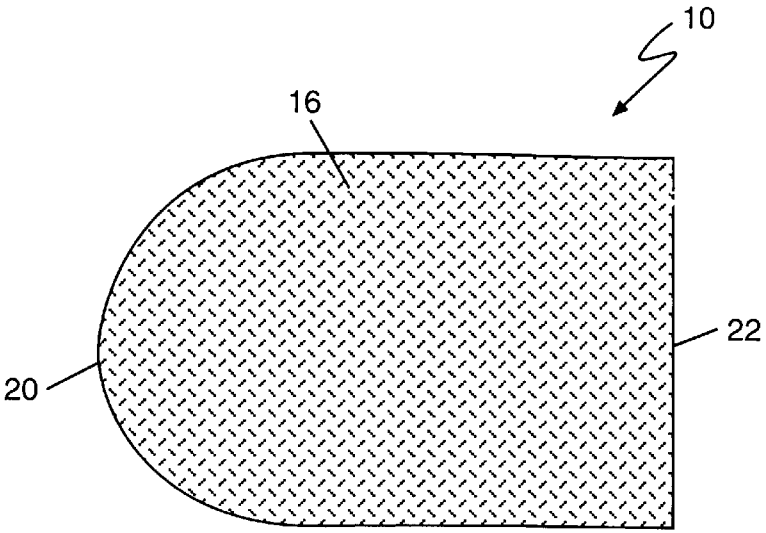
FIG. 5 is a bottom plan view of the shoe insert of the present invention.
Figure 4:
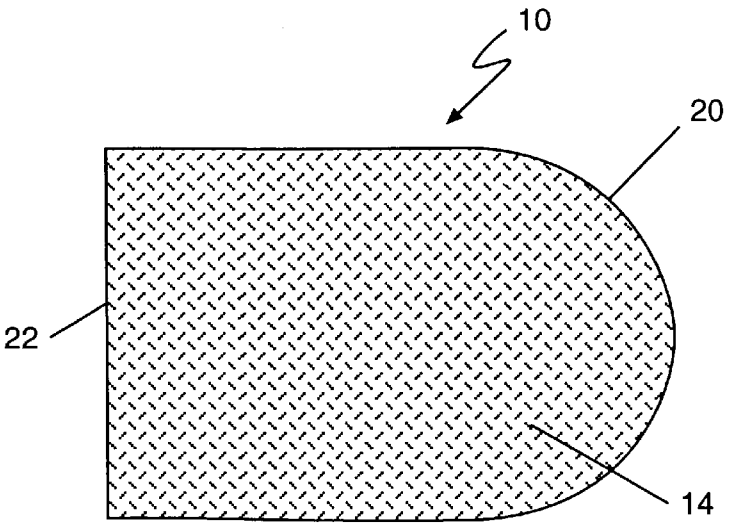
FIG. 4 is a top plan view of the shoe insert of the present invention.
Figure 6:
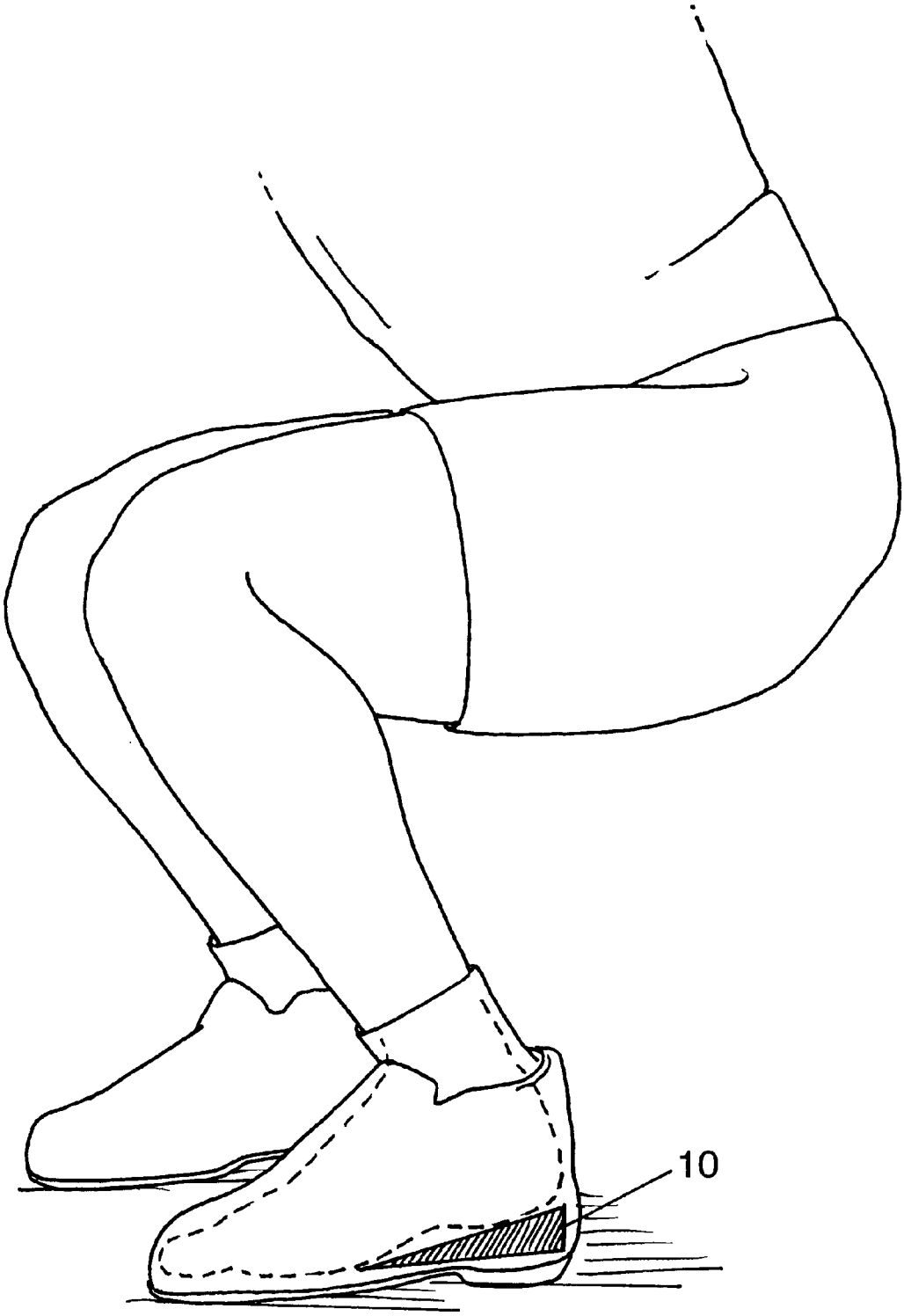
FIG. 6 is a perspective view showing a man doing "squats" while using the shoe insert of the present invention.

The exercise is performed by first standing in an upright position. The user's feet should be approximately shoulder width apart with the user's toes pointed slightly outward. The user starts by moving his or her butt back and downward as if sitting in a chair as shown in FIG. 5. The user then bends at the knee and continues downward until the thighs are parallel to the ground. The user then straightens the knees and returns to a standing position. This process is repeated by the user a pre-determined number of times (i.e. repetitions).

One advantage of using the shoe insert 10 is that the heel is raised by the insert without using a board as is the prevailing practice. Thus, the present invention prevents the useless waste of energy in trying to obtain proper position thereby allowing the energy to be expended on more repetitions. The present invention is also safer to use since there is no need to "back-up" while carrying heavy weights in order to get into the proper position.

Another advantage of the present invention is the shoe insert 10 of the present invention provides arch support during weight-training exercises. The prior art method, in contrast, provide no support for the user arch since a gap existed between the user's foot and the ground. Thus the shoe insert 10 consequently provides increased comfort and minimizes a potential source of injury to the user.

What is claimed is:

1. An exercise method comprising:

a) providing a wedge-shaped shoe insert;

b) placing the shoe insert into the heel of a shoe;

c) securing the shoe to a user's foot so that the heel of the user is raised by the insert;

d) performing a weight-training exercise while the shoe insert is placed in the user's shoe.

2. The exercise method of claim 1 wherein the weight-training exercise is a squat.

3. The exercise method of claim 1 wherein the weight-training exercise is performed with a resistance apparatus.

4. The exercise method of claim 3 wherein the resistance apparatus is a free-weight barbell.

* * * * *

UNITED STATES PATENT AND TRADEMARK OFFICE

CERTIFICATE OF CORRECTION

PATENT NO. : 6,041,523
DATED : March 28, 2000
INVENTOR(S) : Wayne H. Deloreia

It is certified that error appears in the above-identified patent and that said Letters Patent is hereby corrected as shown below:

Title page,
Item [76], the last name of the inventor was misspelled. The correct spelling is
-- Deloriea. --

Signed and Sealed this

Second Day of December, 2003

JAMES E. ROGAN
*Director of the United States Patent and Trademark Office*